United States Patent [19]

Barriac

[11] Patent Number: 4,723,669

[45] Date of Patent: Feb. 9, 1988

[54] CHILD RESISTANT DISPENSING CLOSURE SYSTEM

[75] Inventor: Jacques J. Barriac, Toledo, Ohio

[73] Assignee: Owens-Illinois Closure Inc., Toledo, Ohio

[21] Appl. No.: 1,772

[22] Filed: Jan. 9, 1987

[51] Int. Cl.[4] ..... B65D 55/02; A61H 1/00

[52] U.S. Cl. ..... 215/206; 215/211; 215/216; 215/235; 215/237

[58] Field of Search ..... 215/211, 216, 235, 237, 215/330, 206; 222/153

[56] References Cited

U.S. PATENT DOCUMENTS 4,383,618 5/1983 Dougherty ..... 215/216

4,629,081 12/1986 McLaren ..... 215/211

*Primary Examiner*—George T. Hall

*Attorney, Agent, or Firm*—H. G. Bruss

[57] ABSTRACT

A closure system for threaded containers wherein the closure is of the dispensing type and is child resistant in two aspects. Interengaging lugs on the closure skirt and container neck are so arranged that a squeezing force is required to permit the closure being unthreaded from the container. A dispensing opening in the closure top is closed by a hinged cap that meets with the upper rim of the closure in a parting line. At this parting line both the hinged cap and the top of the closure have matching protruberances that require the squeezing of the lower one in order to push up or release the cap. The plastic material of the cap and the closure are sufficiently strong that a child is unable to flex or squeeze the closure enough to open the cap or unthread the closure from the container.

2 Claims, 4 Drawing Figures

CHILD RESISTANT DISPENSING CLOSURE SYSTEM

BACKGROUND OF THE INVENTION

This invention relates to a child resistant safety closure for necked containers and, more particularly, to improved child resistant dispensing closures. There are a wide variety of child resistant closures so named because of the difficulty of children removing the closure or opening the dispensing opening in the closure. Such closures have incorporated hinged locking flaps that cooperate with a body portion to effect the closing of one or more dispensing openings in the body portion. Typical of such prior art disclosures are found in U.S. Pat. Nos. 3,845,872 to Townes, 3,927,805 to Stull, 4,022,352 to Pehr, and more recently, 4,371,095 to Montgomery et al. These patents have only a single child resistant feature. Another U.S. Pat. No. 4,209,100, discloses a similar integral flap for closing a dispensing opening in the body portion and a non-removal feature for preventing removal of the body from a container neck that has locking means. The safety feature of these patents rely on the requirement that manipulation of the body relative to the flap is necessary to raise or expose the flap. One inherent problem is that regardless of the difficulty or the unlikelihood that the child can open the dispensing flap by chance, the body could be removed without difficulty, with exception of the last mentioned patent. However, in the case of this last mentioned patent, the body cannot be removed by a discerning adult since it is designed to not be unthreaded once it is fully applied. Further, the possibility of inadvertent opening by a child while banging the container against a hard surface in such a manner as to release the flap detracts from its safety purpose.

SUMMARY OF THE INVENTION

In accordance with the present invention, a child resistant dispensing closure system is provided of the type having an inverted cup-shaped body or base portion to which a cap portion is integrally hinged. The base portion is formed with internal threads which cooperate with the threaded neck of a container to provide a means to releasably attach the base portion to the container neck. The container neck is formed with a series of radial locking splines which cooperate with a pair of diametrically opposed lugs formed on the interior of the closure skirt below the threads to lockingly engage the splines. The lower skirt portion of the closure, at diametrically opposed locations 90° removed from the lugs, is formed with outwardly and downwardly flared sidewalls which, when squeezed toward each other, will release the lugs from the splines. The hinged cap carries a depending annular member that will enter the dispensing spout formed in the top of the base when the cap is hinged into closed position. The external sidewall of the cap and the sidewall of the base are identical in external configuration to frustrate easy hinging of the cap which can only be done by depressing a radially protruding, flexible upper rim portion of the base to expose the lower edge of the cap sidewall opposite the hinge.

The force required to actuate the closure to initiate the opening of the cap is that produced by compression action between the thumb and forefinger and it is possible to design the closure so that such force is beyond the capability of a child.

The same can be said for the compressive force required to squeeze the lower skirt simultaneously with turning to effect removal of the closure system from a container.

It can thus be seen that both the dispensing feature of the closure, as well as the removal feature, are designed to be child resistant. A closure system having two child resistant features is provided for a dispensing closure.

Other advantages will become apparent from the following detailed description taken in conjunction with the annexed sheets of drawings.

DETAILED DESCRIPTION OF THE DRAWINGS

Figure 1:
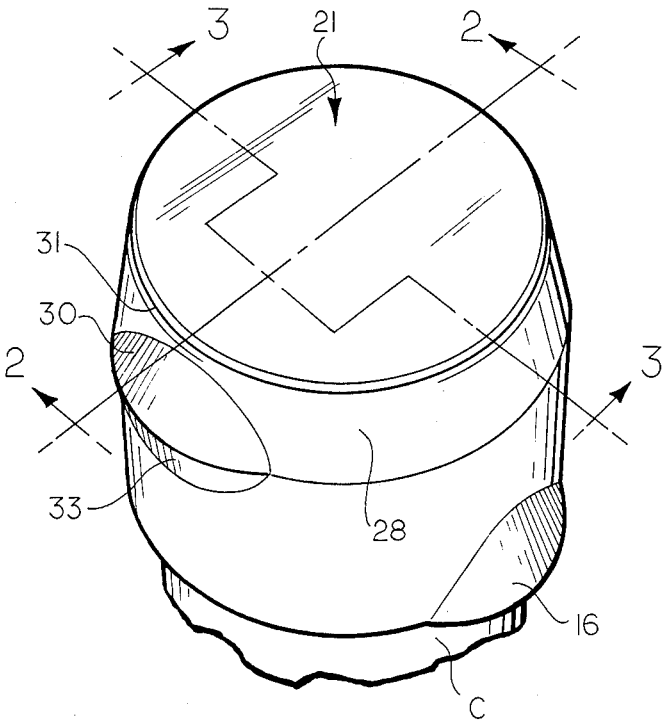
FIG. 1 is a perspective view of the closure of the invention.
Figure 3:
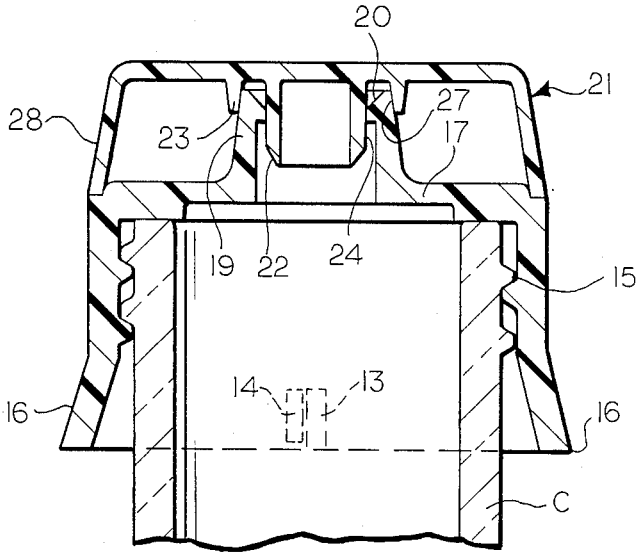
FIG. 3 is a cross-sectional view taken at line 3—3 of FIG. 1.

With particular reference to the drawings, it can be seen that the closure of the invention comprises a generally cylindrical closure body 10 with a depending skirt 11 that has internal threads 12. The body 10 is provided, adjacent the bottom of the skirt, with a pair of inwardly extending, diametrically opposed, vertical splines 13. The splines 13 cooperate with radially, outwardly extending lugs 14 formed on the exterior of the container C neck below the external threads 15.

Figure 4:
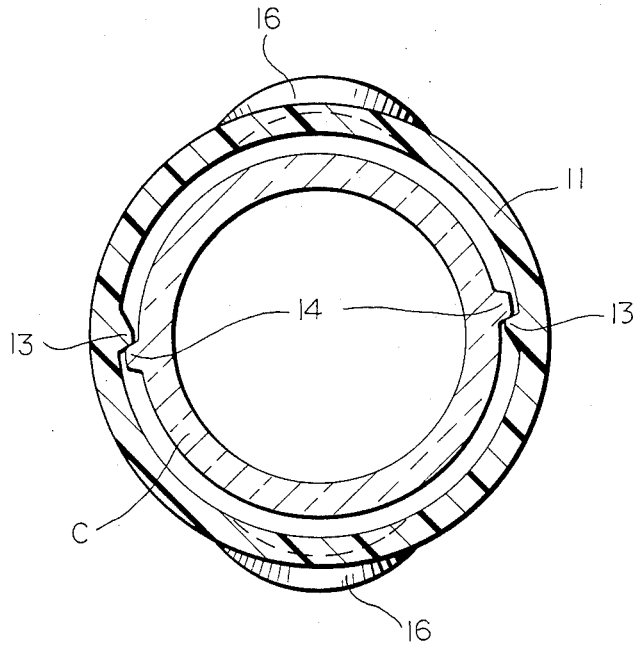
FIG. 4 is a cross-sectional view taken at line 4—4 of FIG. 2.

In the normal application of the closure body 10 to the container C, the splines 13 will flex and pass the lugs 14 during the threading on of the closure. However, once the closure is applied, reversal of the closure is resisted by the interengaging lugs and splines. The splines, in order to be more positive in the locking position, may be sloped in the "threading-on" direction and essentially squared, in configuration, in the unthreading direction, as shown in FIG. 4. In order for the closure body 10 to be removed from the container C, the lower skirt portion of the body is molded with a pair of outwardly flared areas 16 which are diametrically displaced with respect to the splines 13. Grasping of the closure by the thumb and forefinger and exerting a squeezing force will cause the flared areas 16 to move toward each other with the concommitant bowing out of the spline containing zones that are at 90° with respect thereto. This bowing out at the 90° displaced positions will allow the splines to clear and pass easily over the container lugs 14 when the body 10 is rotated relative to the container C. Thus it can be seen that the closure 10 has a "child resistant" application to the container.

Figure 2:
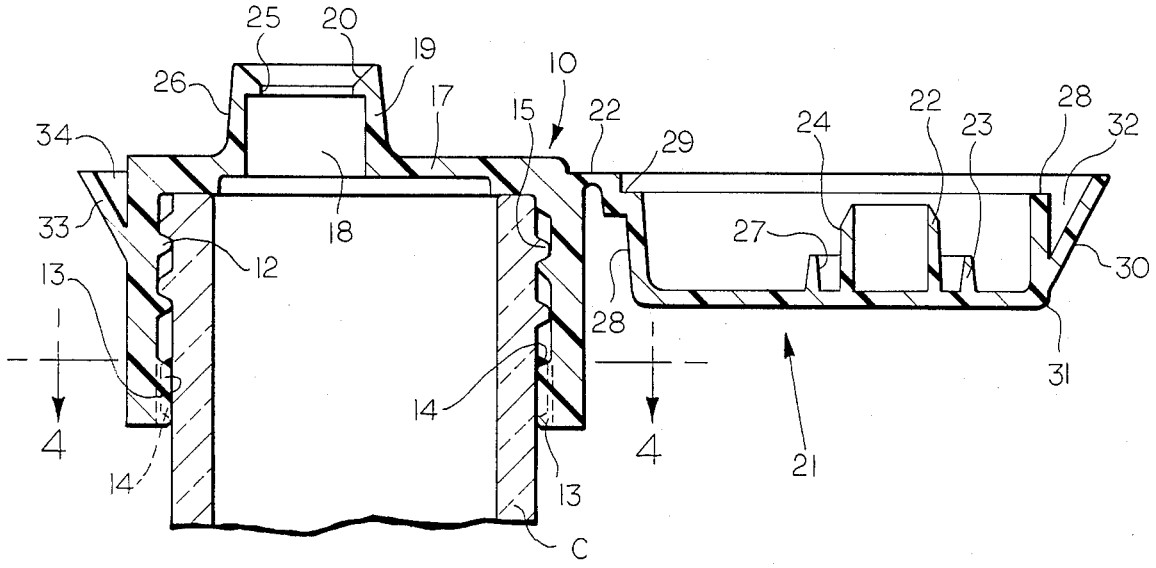
FIG. 2 is a cross-sectional view taken at line 2—2 of FIG. 1, with the hinged cap in open position.

The clousre is one which is also characterized as having a pour-out opening that is also designed to be "child resistant" in the pour-out feature as well. As best seen in FIG. 2, the body 10 of the closure has a generally horizontal top wall 17 formed with a pour-out opening 18 therein. The opening 18 leads to a cylindrical pour spout 19 that has an outwardly flared opening 20 at its upper end. A cap 21 is hinged at 22 to the upper edge of the body 10. The interior of the cap 21 has a pair of concentric, cylindrical members 22 and 23 extending from the inner surface thereof. The smaller member 22 has a tapered annular edge at its extending end which is adapted to enter the opening 20 in the spout 19 and effectively form a seal with its outer surface 24 against the inner surface 25 of the opening 20 in the spout 19. Additionally, the outer end of the spout 19 will enter the gap between the members 22 and 23 and the member 23 will engage the outer surface 26 of the spout 19 since there is a slight taper to both the surface 26 and the inner surface 27 of the member 23.

As best seen in FIGS. 1 and 2, the cap 21 has a generally cylindrical outer side wall or skirt portion 28 that is joined by an outward step 29 to the hinge 22. The top wall 17 of the body 10 is formed with an annular step down which will cooperate with the step 29 of the cap when the cap is hinged into closed position, as shown in FIG. 1. The skirt portion 28 of the cap 21 is also formed with an outwardly spaced wall portion 30 that is integrally formed to the top edge at 31 but extends outwardly at an angle to the vertical but with its side 30 molded to the outside of the skirt 28 to form, what might be likened to the upper half of a parrots beak, with a hollow area 32 between the side 30 and the outside of the skirt portion 28.

The skirt 11 of the body 10, at the circumferential position of 180° from the hinge 22, has an integrally formed, outwardly spaced wall portion 33 with a hollow 34 between it and the outer wall of the skirt 11. This wall portion 33 is also like a parrots beak in appearance and will be complimentary with the upper wall portion 28 to form an outwardly extending bulge in the otherwise cylindrical skirt and cap sidewall configuration.

With these protruding wall portions in juxtaposed relationship when the cap is in its closed position, as shown in FIG. 1, it will be difficult for a child to grasp the cap and swing it about the hinge. These is nothing but smooth surfaces appearing on the outside of the cap and closure body.

An adult, however, can compress the wall portion 33 inwardly with the thumb and raise the cap wall 30 with the underlying thumbnail to effect opening of the pour spout. The cap is formed of a sufficient pliable plastic, such as polypropylene, so that such manipulation may be performed by an adult but be totally beyond the capability of a child.

Furthermore, by having the dual child resistant closure features, the package is readily manipulated by an adult to provide a choice of how access to the contents of the container may be achieved.

What is claimed:

1. A dual child resistant dispensing closure system for a container wherein the container has a threaded neck and at least a pair of opposed, outstanding lugs; and the closure is integrally molded of a resilient plastic in the form of an inverted cup-shaped base portion, a cap portion connected to the upper edge of said base portion by an integral hinge; and with a horizontal top wall closing the top of said base portion and a dispensing opening formed in and extending above said top wall, the improvement comprising, said base portion formed with a cylindrical depending skirt having a pair of outwardly flared, diametrically opposed bulges at the lowermost edge thereof, a pair of internal lugs formed in said skirt at 90° with respect to said bulges, said cap portion and said base portion forming a matching parting line about the circumference of said closure, inwardly deflectable means in said cap portion and said body portion on opposite sides of said parting line, said inwardly deflectable means comprises an integrally formed, radially outwardly extending, upper rim segment at the top of said skirt portion of said base diametrically opposed to the hinge for the cap portion, said rim segment being formed as a membrane extending out of the vertical plane of the cylinder of the skirt and adapted to be displaced inwardly by a force applied thereto, said cap portion being formed with a cylindrical skirt and flat top, a complementary protrusion formed integrally with the skirt of said cap at a diametrically displaced position relative to the hinge connection of the cap and base, said protrusion overlying said rim segment when said cap is hinged into overlying, closing relationship to the top of said base portion.

2. The closure system of claim 1 wherein said upper rim segment and said bulges on said cap are formed of a plastic material having a resistance to deflection which is beyond the strength capabilities of a child.

* * * * *